US010427058B2

(12) United States Patent
Whyman et al.

(10) Patent No.: US 10,427,058 B2
(45) Date of Patent: Oct. 1, 2019

(54) PLAY STRUCTURE AND BRACKET FOR PLAY STRUCTURE

(71) Applicant: Leisure Time Products, LLC, Pittsburg, KS (US)

(72) Inventors: Daniel R. Whyman, Lamar, MO (US); Scott Alan Moser, Pittsburg, KS (US); John Allen Vura, Pittsburg, KS (US)

(73) Assignee: LEISURE TIME PRODUCTS, LLC, Pittsburg, KS (US)

( * ) Notice: Subject to any disclaimer, the term of this patent is extended or adjusted under 35 U.S.C. 154(b) by 0 days.

(21) Appl. No.: 16/111,511

(22) Filed: Aug. 24, 2018

(65) Prior Publication Data

US 2019/0105574 A1 Apr. 11, 2019

Related U.S. Application Data

(60) Provisional application No. 62/570,724, filed on Oct. 11, 2017.

(51) Int. Cl.
*A63G 9/12* (2006.01)
*A63G 9/02* (2006.01)

(52) U.S. Cl.
CPC ..... *A63G 9/12* (2013.01); *A63G 9/02* (2013.01)

(58) Field of Classification Search
CPC ... A63G 9/12; A63G 9/02; A63G 9/00; G08B 21/00; E04C 2/30
USPC ..... 472/118; 52/713, 703, 848, 638, 633, 52/634, 696; 248/218.4
See application file for complete search history.

(56) References Cited

U.S. PATENT DOCUMENTS 4,966,309 A * 10/1990 Baer ..... A63G 9/00 248/165
5,016,873 A * 5/1991 Bossa ..... A63G 9/00 248/163.2
5,240,342 A * 8/1993 Kresa, Jr. ..... E04B 1/2612 248/300
6,302,801 B1 * 10/2001 Zeilinger ..... A63G 9/12 248/165
7,186,183 B2 * 3/2007 Zeilinger ..... A63G 9/02 248/370
7,235,019 B1 * 6/2007 LeCher ..... A63G 9/00 403/217
7,712,283 B2 * 5/2010 Gadd ..... E04B 21/2612 248/218.4
8,387,339 B2 * 3/2013 Birch ..... E04B 2/827 52/243.1
8,726,606 B2 * 5/2014 Strickland ..... E04C 3/07 52/636

(Continued)

OTHER PUBLICATIONS

Backyard Discovery; Liberty II Wooden Play Set Model 44215 Owner's Manual; Revised Oct. 14, 2013; 112 pages.

(Continued)

*Primary Examiner* — Michael D Dennis
(74) *Attorney, Agent, or Firm* — Ulmer & Berne LLP

(57) ABSTRACT

A bracket for a play structure includes a first flange and a second flange. The first flange includes a proximal end and a distal end. The first flange extends along a plane. The second flange extends from the first flange at the proximal end such that the second flange is disposed on one side of the plane. The pair of side flanges extend from the first flange such that the pair of side flanges are disposed on an opposite side of the plane as the second flange.

12 Claims, 6 Drawing Sheets

(56) References Cited

U.S. PATENT DOCUMENTS

| | | | | |
|---|---|---|---|---|
| 10,280,617 | B2 * | 5/2019 | Monty | E04B 1/26 |
| 2008/0283702 | A1 * | 11/2008 | Ikerd | E04B 1/2604 248/228.1 |
| 2010/0012795 | A1 * | 1/2010 | Spencer | A63G 9/00 248/121 |
| 2010/0043341 | A1 * | 2/2010 | Staley | E04B 7/063 52/702 |
| 2010/0071141 | A1 * | 3/2010 | Reiner | E01D 15/124 14/73 |
| 2014/0083042 | A1 * | 3/2014 | Hiragaki | F16B 7/182 52/655.1 |
| 2016/0002910 | A1 * | 1/2016 | Green | F16B 7/042 52/848 |

OTHER PUBLICATIONS

Wikipedia article re: Flitch beam; page last edited on Oct. 16, 2017; retrieved from https://en.wikipedia.org/wiki/Flitch_beam on Aug. 29, 2018; 2 pages.

* cited by examiner

PLAY STRUCTURE AND BRACKET FOR PLAY STRUCTURE

TECHNICAL FIELD

The apparatus and methods described below generally relate to an extension assembly for a beam member of a play structure. In particular, the extension assembly can include a bracket and an extension member that facilitate attachment of the beam member to a main structure.

BACKGROUND

Conventional play equipment includes a main beam that is attached directly to a main structure for supporting swings. The main beam cooperates with the main structure to provide sufficient structural integrity in which to resist the forces applied to the main beam when swinging on the swings.

BRIEF DESCRIPTION OF THE DRAWINGS

It is believed that certain embodiments will be better understood from the following description taken in conjunction with the accompanying drawings in which.

DETAILED DESCRIPTION

Figure 1:
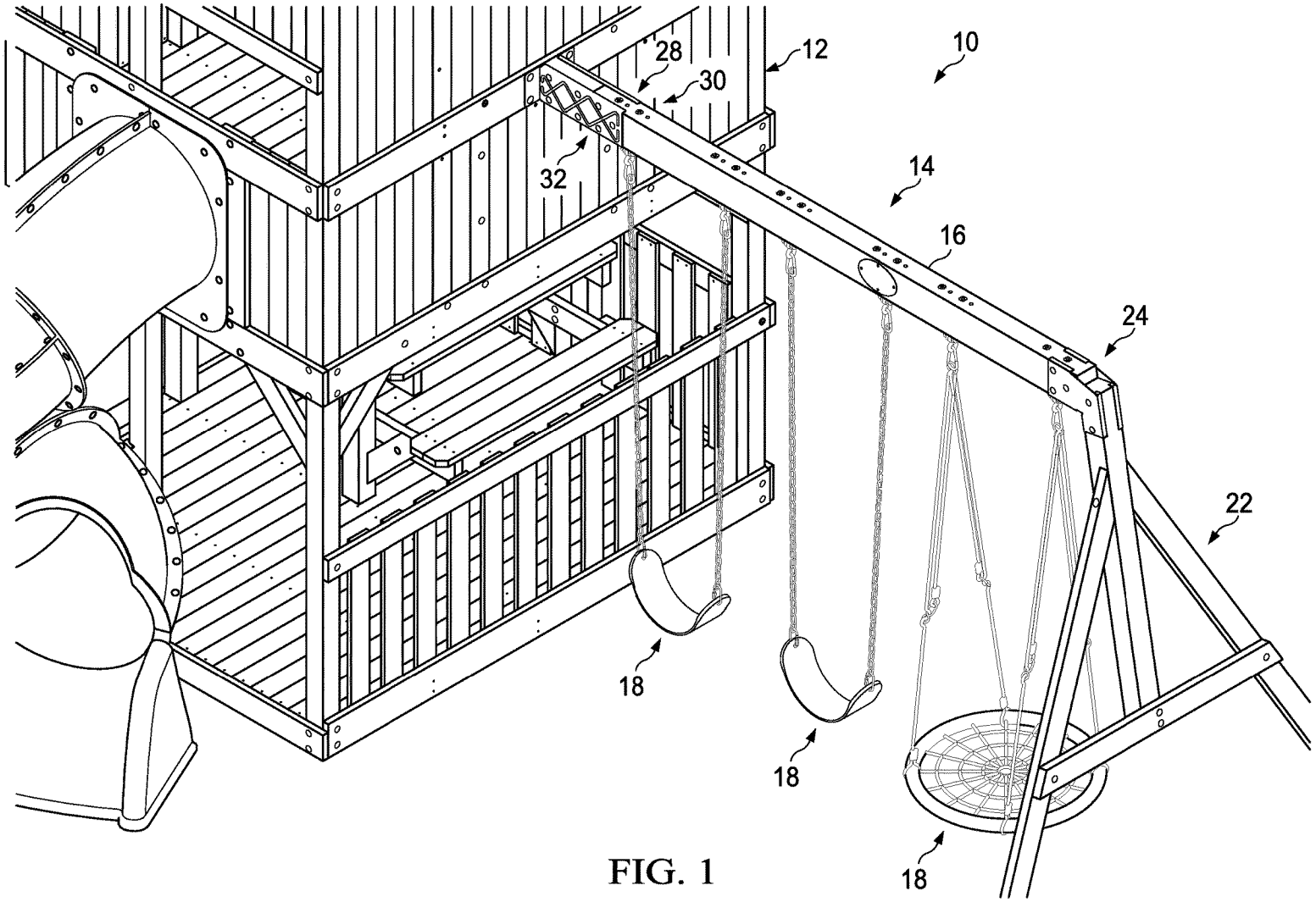
FIG. 1 is an isometric view depicting a swing set, an extension assembly and a main structure.

Selected embodiments are hereinafter described in detail in connection with the views and examples of FIGS. 1-8. As illustrated in FIG. 1, a play structure 10 can include a main structure 12 and a swing set 14 coupled with the main structure 12. The main structure 12 can be a playset, play gym, fort, or any other free-standing, recreational-type structures that encourages recreational play. The main structure 12 can include a variety of features that encourage recreational play, such as a climbing wall, a slide, and/or a fireman's pole, for example.

Figure 2:
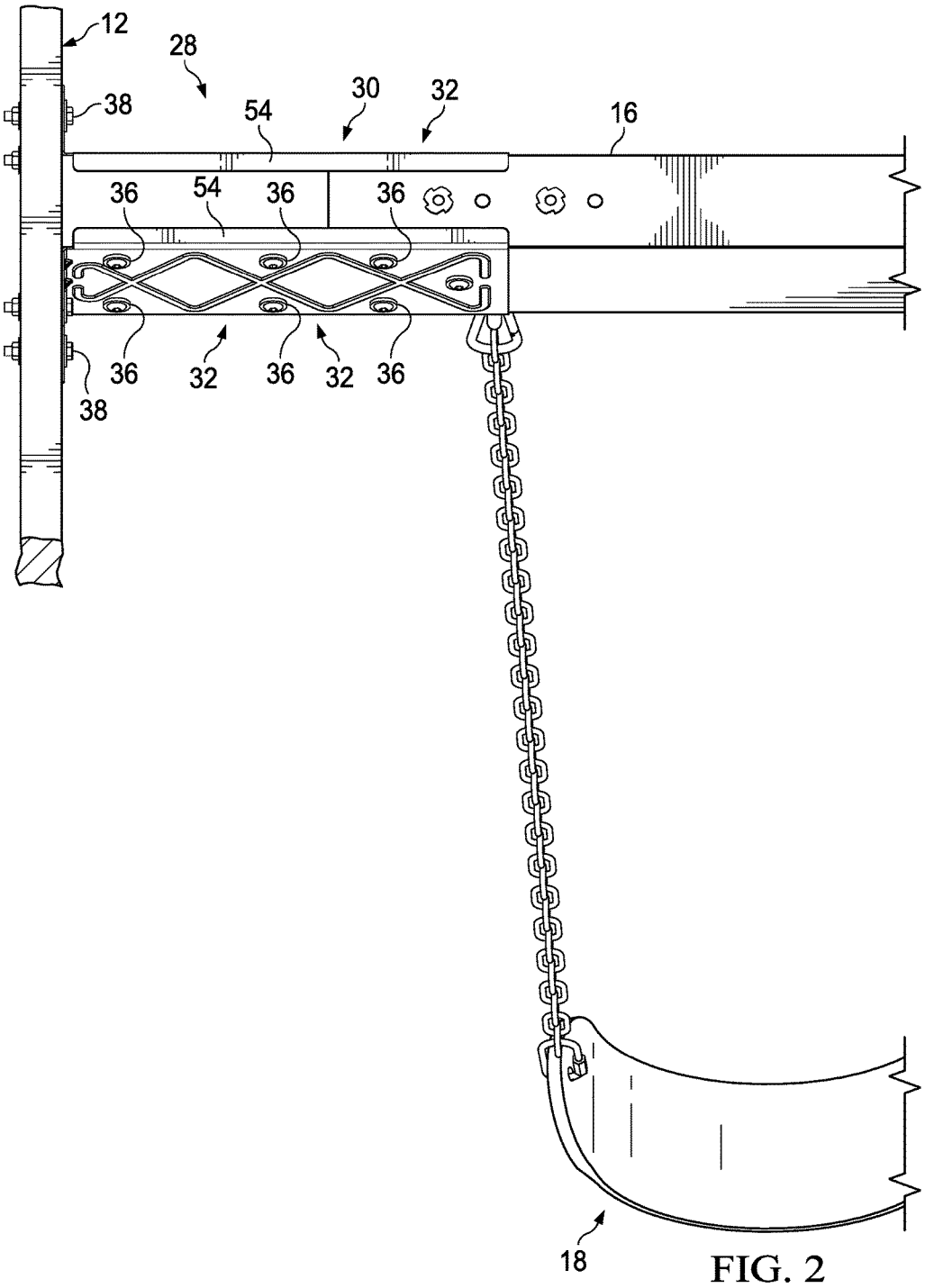
FIG. 2 is an enlarged upper isometric view of the swing set, the extension assembly and the main structure of FIG. 1.

The swing set 14 can include a main beam member 16 and a plurality of swings 18 that are supported by the main beam member 16. A leg assembly 22 can be coupled to a distal end 24 of the main beam member 16 by a pair of brackets 32 (FIG. 2). The leg assembly 22 can facilitate support of the distal end 24 of the main beam member 16 relative to a ground surface. The swing set 14 can be coupled with the main structure 12 by an extension assembly 28 that is coupled to the main structure 12 and to a proximal end 30 of the main beam member 16.

Figure 3:
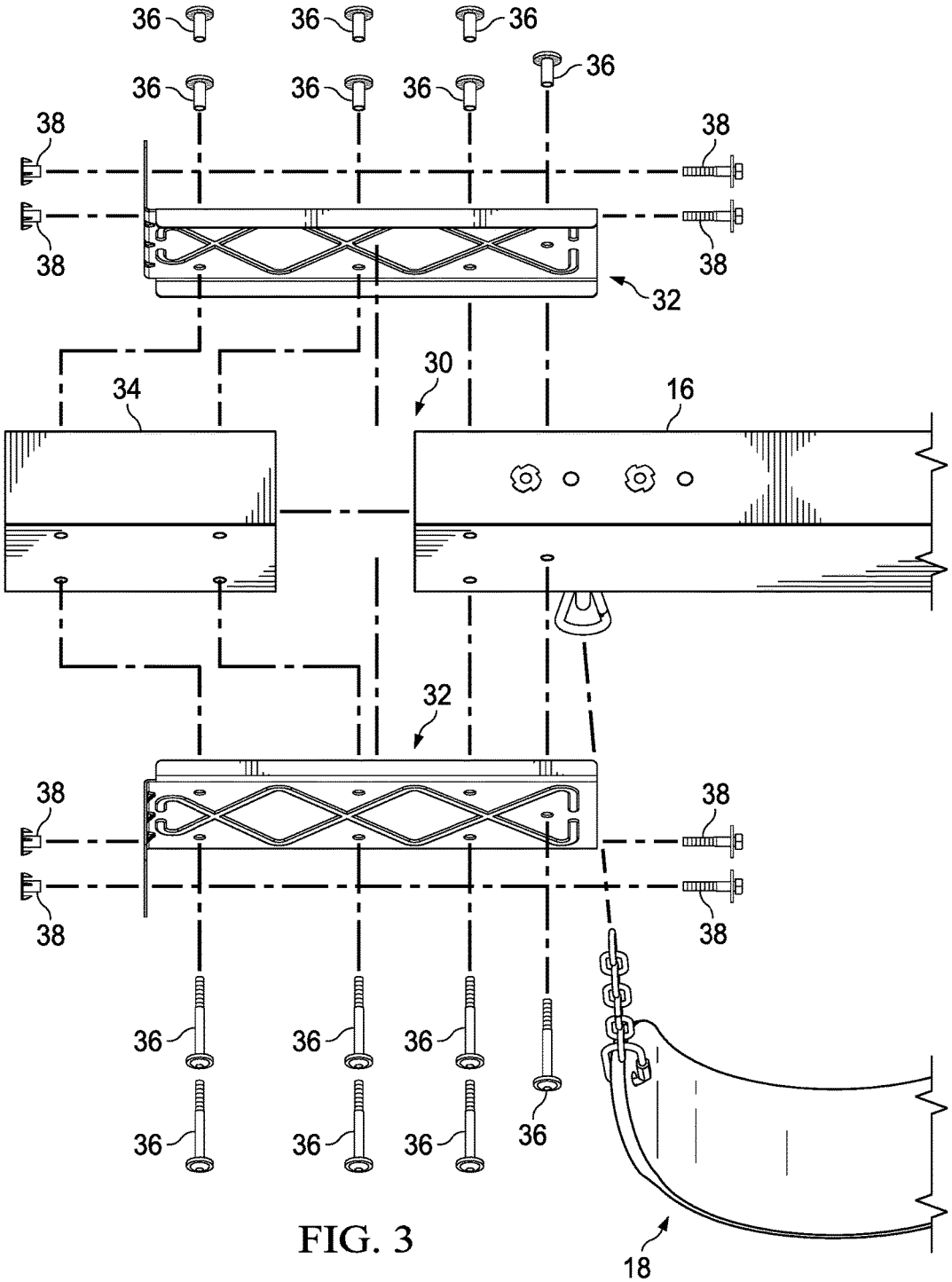
FIG. 3 is an enlarged exploded isometric view of the swing set and the extension assembly of FIG. 1.

Referring now to FIGS. 2 and 3, the extension assembly 28 can include a pair of brackets 32 and an extension block 34. As illustrated in FIG. 2, the extension block 34 can abut the proximal end 30 of the main beam member 16 and can be sandwiched between the brackets 32. The brackets 32 can extend beyond the extension block 34 and can overlie a portion of the proximal end 30 of the extension block 34. Each bracket 32 can be releasably attached to the main beam member 16 and to the extension block 34 with threaded fasteners 36. Each bracket 32 can also be releasably attached to the main structure 12 with threaded fasteners 38. In one embodiment, as illustrated in FIG. 3, the threaded fasteners 36, 38 can comprise a plurality of nut/bolt combinations. It is to be appreciated, however, that the brackets 32 can be secured with any of a variety of fastening arrangements, such as lag bolts, nails, or screws, for example.

Figure 4:
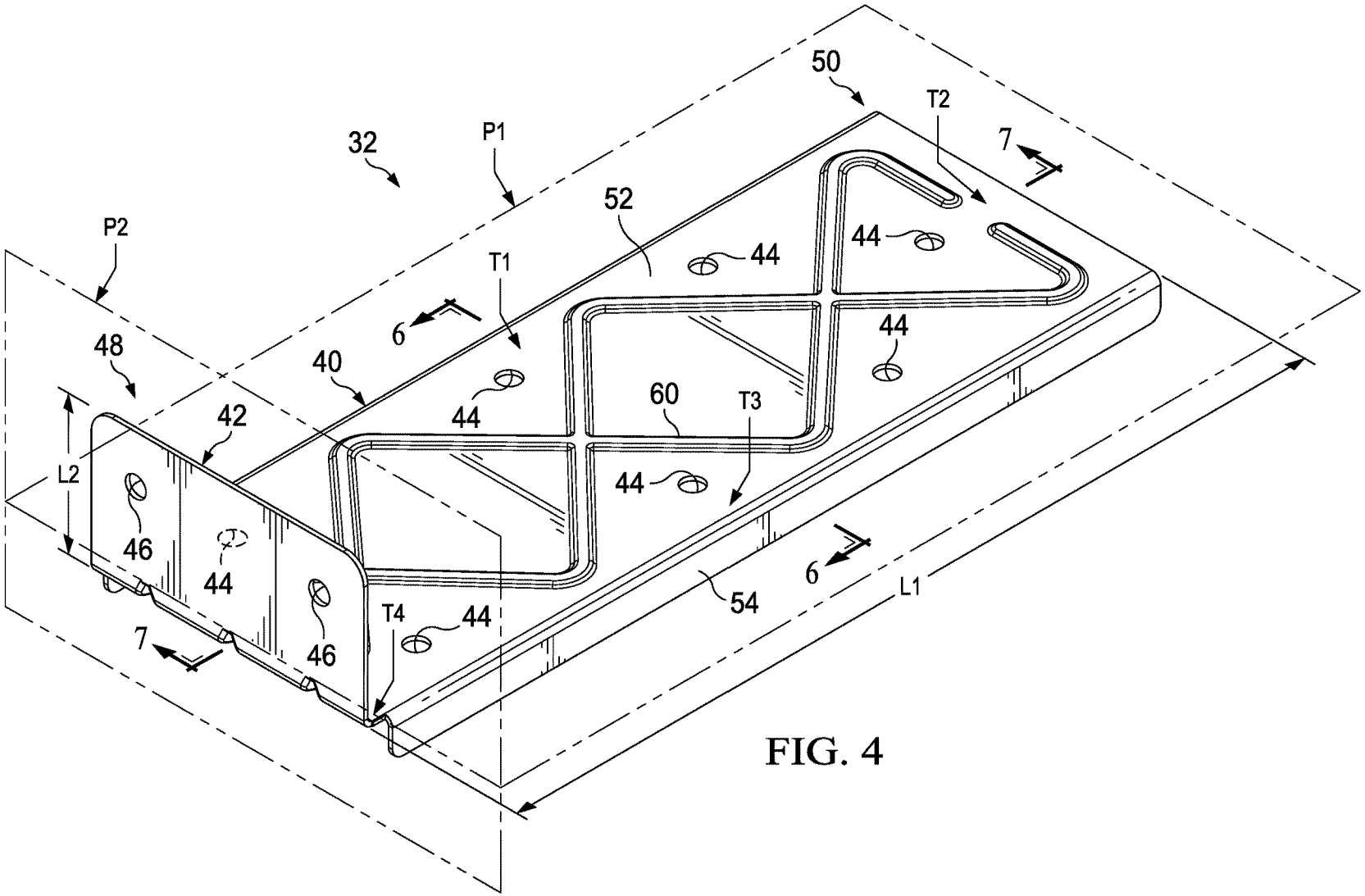
FIG. 4 is an upper isometric view depicting one bracket of the extension assembly of FIG. 1.

In one embodiment, the brackets 32 can be substantially identical with one another such that the brackets 32 can be used interchangeably. Referring now to FIG. 4, one of the brackets 32 is illustrated as a representative example of each of the brackets 32 illustrated in FIGS. 2 and 3. The bracket 32 can include a main flange 40 and a tab flange 42. The main flange 40 and the tab flange 42 can each define a respective plurality of apertures 44, 46 to accommodate the threaded fasteners 36, 38, respectively. The main flange 40 include a proximal end 48 and a distal end 50 and can extend along an imaginary plane P1. It is to be appreciated that a flange (e.g., the main flange 40) being described as extending along the imaginary plane P1 can be understood to mean that the imaginary plane P1 resides in the flange at opposite ends of its longest length and at opposite ends of its widest width. In one embodiment, as illustrated in FIG. 4, the imaginary plane P1 can be defined by an upper surface 52 of the main flange 40 such that the imaginary plane P1 resides in the main flange 40 at four points T1, T2, T3, T4 (e.g., located at opposite ends of its longest length and at opposite ends of its widest width).

The tab flange 42 can extend from the main flange 40 at the proximal end 48 such that the tab flange 42 is disposed on one side of the imaginary plane P1. In one embodiment, the tab flange 42 can be generally orthogonal to the main flange 40 such that the main flange 40 and the tab flange 42 are substantially L-shaped. In such an embodiment, the tab flange 42 can extend along an imaginary plane P2 that is generally orthogonal to the imaginary plane P1. It is to be appreciated, however, that the tab flange 42 can be oriented with respect to the main flange 40 at any included angle (e.g., any angle that is greater than 0 degrees and less than 180 degrees).

Still referring to FIG. 4, the main flange 40 can have a length L1 and the tab flange 42 can have a length L2. In one embodiment, the length L1 of the main flange 40 can be at least five times longer than the tab flange 42. In such an embodiment, the length L1 can between about 354 mm and about 400 mm, and preferably about 382 mm. The length L2 can be between about 55 mm and about 70 mm, and preferably about 68 mm.

Figure 5:
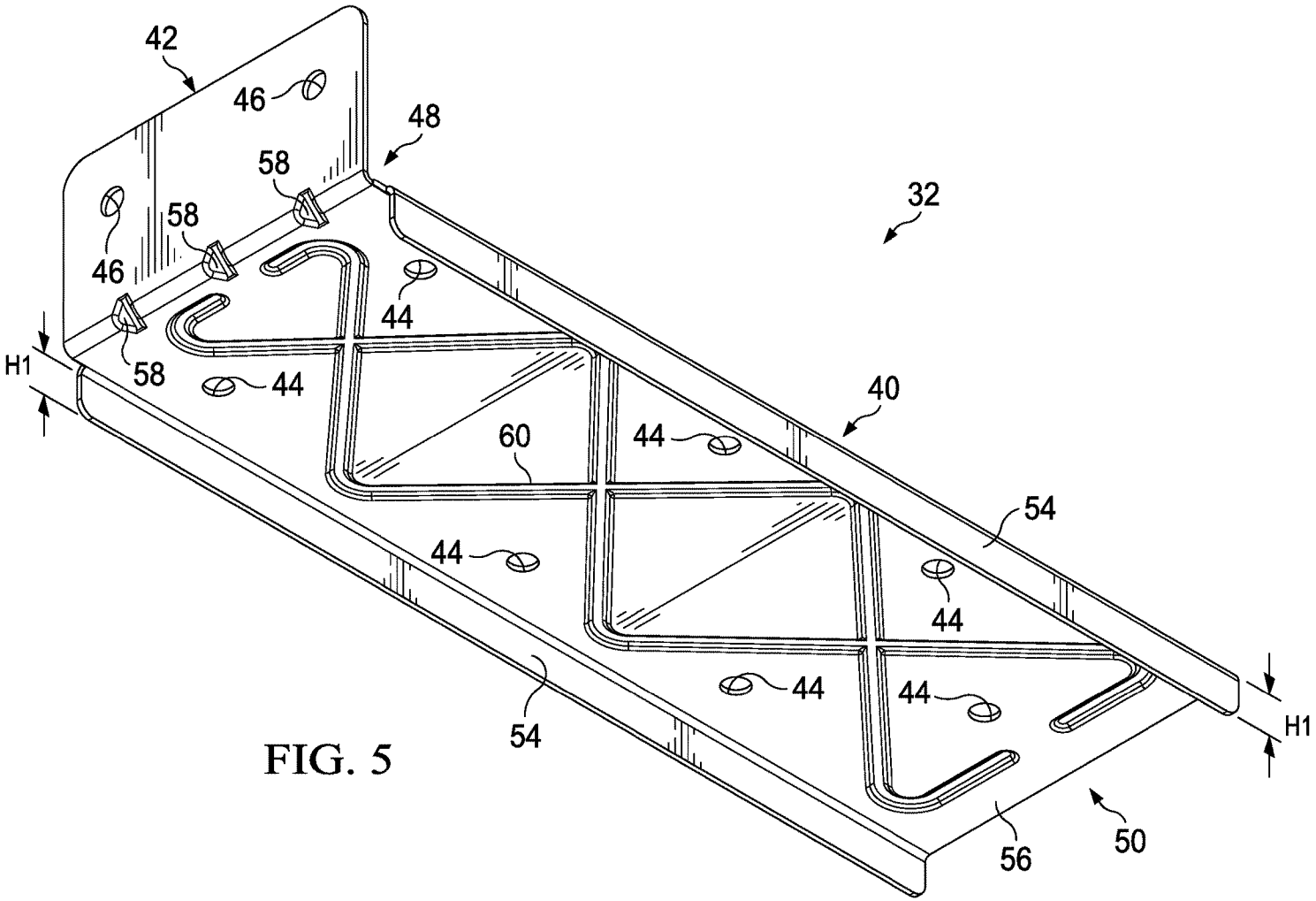
FIG. 5 is a lower isometric view depicting the bracket of FIG. 4.

Referring now to FIG. 5, a pair of side flanges 54 can extend from the main flange 40 such that the side flanges 54 are disposed on an opposite side of the imaginary plane P1 as the tab flange 42. Each of the side flanges 54 can be spaced apart from each other such that a lower surface 56 is interposed between the pair of side flanges 54. The side flanges 54 are each shown to extend substantially entirely between the proximal end 48 and the distal end 50 of the main flange 40. However, each of the side flanges 54 can be any length relative to the length L1 of the main flange 40.

Figure 6:
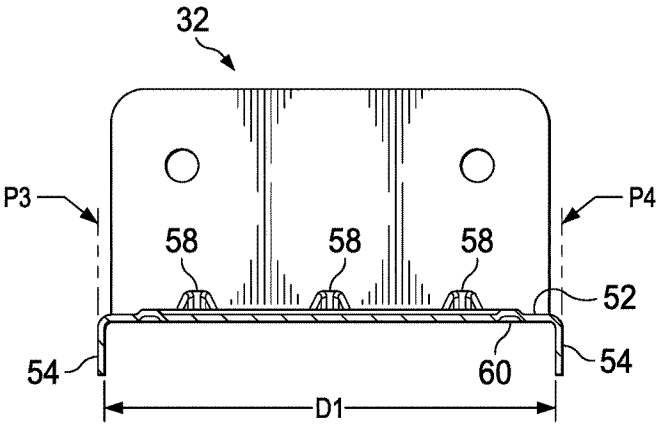
FIG. 6 is a cross sectional view taken along the line 6-6 in FIG. 4.

Referring now to FIG. 6, each of the side flanges 54 can be generally orthogonal to the main flange 40 such that the main flange 40 and the side flanges 54 cooperate to form a substantially C-shaped cross section. In such an embodiment, each of the side flanges 54 can extend along respective imaginary planes P3, P4 that are each generally orthogonal to the imaginary plane P1. It is to be appreciated, however, that the side flanges 54 can each be oriented with respect to the main flange 40 at any included angle (e.g., any angle that is greater than 0 degrees and less than 180 degrees) which can be the same or different from each other.

Still referring to FIG. 6, each of the side flanges 54 can have a height H1 that can be between about 15 mm and about 25 mm and preferably about 18 mm. Each of the side flanges 54 can be spaced apart by a distance D1 that can be between about 120 mm and about 154 mm and preferably about 136 mm. It is to be appreciated, however, that the side flanges 54 can be any height which can be the same or different from each other.

Figure 7:
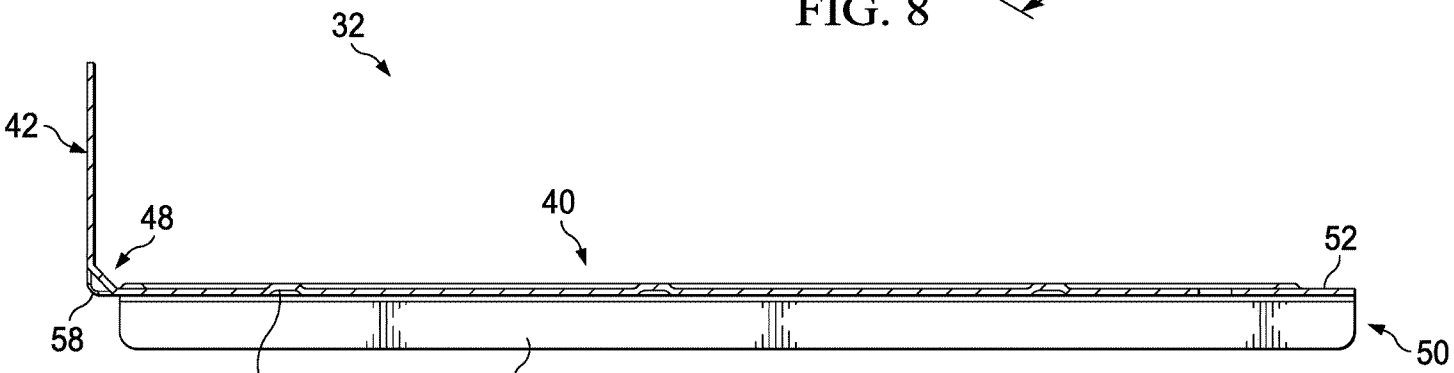
FIG. 7 is a cross sectional view taken along the line 7-7 in FIG. 4.

Referring now to FIGS. 6 and 7, the bracket 32 can include a plurality of corner rib members 58 that extend between the main flange 40 and the tab flange 42. In one embodiment, as illustrated in FIG. 6, the corner rib members can be angled with respect to each of the main flange 40 and the tab flange 42 by about 45 degrees. The corner rib members 58 can enhance the overall strength between main flange 40 and the tab flange 42 to prevent the bracket 32 from easily bending when attached to each of the main structure 12 and the swing set 14.

Referring now to FIGS. 4-7, the main flange 40 can include a rib portion 60 that extends upwardly from adjacent portions of the main flange 40 and enhances the overall strength of the main flange 40. In particular, the rib portion 60 can extend above the upper surface 52 (see FIGS. 6 and 7) such that the rib portion 60 is recessed with respect to the lower surface 56. The rib portion 60 can be routed between the proximal end 48 and the distal end 50 of the main flange 40 to enhance the overall strength along substantially the entire length L1 of the main flange 40. In one embodiment, as illustrated in FIGS. 4 and 5, the rib portion 60 can be routed along the main flange 40 in a repeating rhombus pattern, but in other embodiments, can be routed along in the main flange in any of a variety of patterns.

Figure 8:
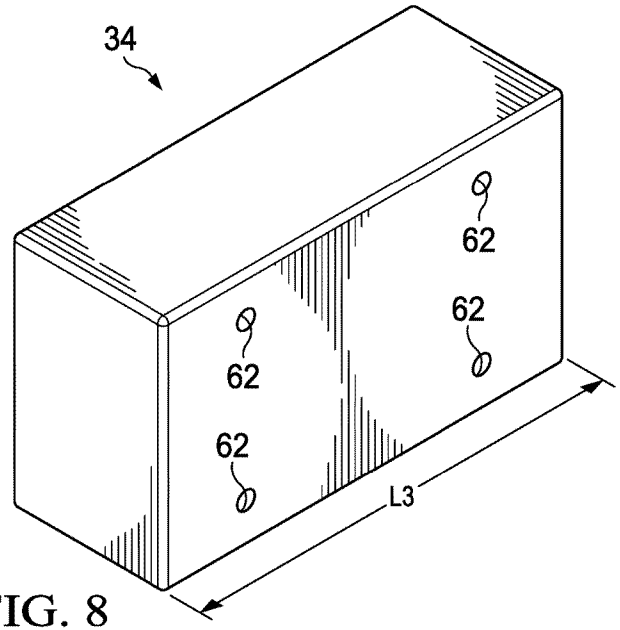
FIG. 8 is an isometric view of an extension block of the extension assembly of FIG. 1.

Referring now to FIG. 8, the extension block 34 can have a similar overall cross sectional shape as the main beam member 16 and can be formed of wood, metal, a composite material or any other suitable material. In one embodiment, the extension block 34 can be formed of the same material as the main beam member 16. The extension block 34 can define a plurality of through holes 62 that align with certain of the apertures 44 on the main flange 40 to accommodate the threaded fasteners 36 therethrough. The extension block 34 can have a length L3 that is shorter than the length L1 of the main flanges (e.g., 40) of the brackets 32 to allow the main flanges (e.g., 40) to extend beyond the extension block 34 at to the proximal end 30 of the main beam member 16. In one embodiment, the length L3 can be between about 200 mm and about 250 mm and preferably about 228 mm.

Referring again to FIG. 2, when the extension assembly 28 is installed on the main beam member 16, the extension block 34 can be sandwiched between the brackets 32 and the main flange 40 can extend beyond the extension block 34 and onto the proximal end 30 of the main beam member 16 such that the main flanges 40 can be attached to each of the main beam member 16 and the extension block 34 (e.g., with the threaded fasteners 36). The brackets 32 can therefore facilitate attachment of the main beam member 16 and the extension block 34 together with enough rigidity to prevent undesirable twisting of the main beam member 16 and the extension block 34 relative to each other (e.g., during swinging on the swings 18).

The height of each of the proximal end 30 of the main beam member 16 and the extension block 34 can be slightly less than the distance D1 between respective pairs of the side flanges 54. As such, when the extension assembly 28 is installed on the main beam member 16, as illustrated in FIG. 2, the proximal end 30 of the main beam member 16 and the extension block 34 can fit between respective pairs of the side flanges 54. Each of the side flanges 54 can at least partially overlie each of the proximal end 30 of the main beam member 16 and the extension block 34 to further enhance the prevention of undesirable twisting of the main beam member 16 and the extension block 34 relative to each other. The side flanges 54 can also aid in aligning the brackets 32 properly onto the main beam member 16 and the extension block 34 during assembly.

As illustrated in FIG. 2, each of the brackets 32 can be attached to the main structure 12 and the swing set 14 at three separate areas—to the proximal end 30 of the main beam member 16 (e.g., with the threaded fasteners 36), to the extension block 34 (e.g., with the threaded fasteners 36) and to the main structure 12 (e.g., with threaded fasteners 38). By attaching the brackets 32 in this manner, the brackets 32 can provide a more sturdy coupling arrangement than conventional end joints for elongated members.

The extension assembly 28 can provide additional length to the swing set 14 at the proximal end 30 of the main beam member 16. The overall length of the swing set 14 is therefore not constrained by the length of the main beam member 16 as with conventional swing sets. For example, conventional swing sets typically only use an individual main beam member that is directly attached to an adjacent structure. The overall length of the swing set is therefore determined solely by the length of the main beam member being used. The length of the main beam member, however, is typically constrained by the dimensions of the particular shipping container being used to ship the play structure when disassembled. In fact, many main beam members have a standard length of about 89.5 inches which is the maximum length that can fit in a standard 92 inch shipping container (thus permitting 5 such shipping containers to be laid end to end on a conventional shipping trailer). These standard length main beam members are oftentimes not long enough to properly space the swings apart and/or to accommodate larger, bulkier swings. It is to be appreciated that while it is certainly possible for swing set designers to use longer main beam members (e.g., at non-standard lengths), the increased cost of shipping these longer main beam members can be cost prohibitive.

The main beam member 16 shown in FIGS. 1-3 can be a standard length and can thus be cost effectively shipped similar to the conventional standard main beams described above. However, by providing the extension assembly 28 at the proximal end 30 of the main beam member 16, the overall length of the swing set 14 can be longer than would otherwise be possible on a conventional swing set. As such, the swings 18 can be spaced further apart than conventional swings sets which can alleviate some of the risk of a user making incidental contact with the main structure 12, the leg assembly 22, and/or other users when swinging on the swings 18. In addition, the additional spacing can also accommodate for larger, bulkier swings (e.g., a tire swing) that might not otherwise be available on conventional arrangements.

The method of assembling the extension assembly 28 onto the main structure 12 and the swing set 14 will now be discussed. First, the extension block 34 can be sandwiched between the brackets 32 and some of the threaded fasteners 36 can be provided through one of the brackets 32, through the extension block 34, and through the other bracket 32 and loosely threaded together to partially assemble the extension assembly 28. The main flanges 40 of the brackets 32 can then be slid over the proximal end 30 of the main beam member 16 and other of the threaded fasteners 36 can be provided through one of the brackets 32, through the main beam member 16, and through the other bracket 32. All of the threaded fasteners 36 can then be tightened to secure the extension assembly 28 to the main beam member 16. The swing set 14 can then be positioned on the main structure with the extension assembly 28 resting against the main structure 12, and the tab flanges 42 of each bracket 32 can be attached to the main structure 12 with the threaded fasteners 38.

It is to be appreciated that, although a swing set (e.g., 10) is described and shown, other types of play equipment or structures that have a main beam are contemplated for use with the extension assembly 28. It is also to be appreciated that the extension assembly 28 can be configured to conform to a variety of different sizes and shapes of main beam members.

The foregoing description of embodiments and examples of the disclosure has been presented for purposes of illustration and description. It is not intended to be exhaustive or to limit the disclosure to the forms described. Numerous modifications are possible in light of the above teachings. Some of those modifications have been discussed and others will be understood by those skilled in the art. The embodiments were chosen and described in order to best illustrate the principles of the disclosure and various embodiments as are suited to the particular use contemplated. The scope of the disclosure is, of course, not limited to the examples or embodiments set forth herein, but can be employed in any number of applications and equivalent devices by those of ordinary skill in the art. Rather it is hereby intended the scope of the invention be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

What is claimed is:

1. A play structure comprising:
a main structure;
a swing set comprising:
a main beam member comprising a proximal end and a distal end;
a pair of leg members coupled with the distal end; and
at least one swing suspended from the main beam member between the proximal end and the distal end; and
an extension assembly comprising:
an extension block disposed between the main structure and the proximal end of the main beam member; and
a first bracket disposed on one side of the main beam member, the first bracket comprising:
a first flange comprising a proximal end and a distal end, the first flange coupled to each of the extension block and the proximal end of the main beam member; and
a second flange extending from the first flange at the proximal end of the first flange and coupled to the main structure such that the first bracket facilitates coupling of the extension block and the main beam member to the main structure, wherein:
the extension block has a first length; and
the first flange has a second length that is greater than the first length.

2. The play structure of claim 1, wherein the second flange is generally orthogonal to the first flange.

3. The play structure of claim 1, wherein the first flange is coupled to each of the extension block and the proximal end of the main beam member with fasteners, and the second flange is coupled to the main structure with fasteners.

4. The play structure of claim 1, wherein:
the first flange extends along a plane;
the second flange is disposed on one side of the plane;
the first bracket further comprises a pair of side flanges extending from the first flange such that the pair of side flanges are disposed on an opposite side of the plane as the second flange; and
the pair of side flanges extend at least partially over one or more of the extension block and the main beam member.

5. The play structure of claim 4, wherein each side flange of the pair of side flanges is generally orthogonal to the first flange.

6. The play structure of claim 1 further comprising at least one corner rib member extending between the first flange and the second flange.

7. The play structure of claim 6, wherein the at least one corner rib member is angled with respect to each of the first flange and the second flange by about 45 degrees.

8. The play structure of claim 1, wherein the first flange comprises a ribbed portion that extends upwardly from an adjacent portion of the first flange.

9. The play structure of claim 1, wherein the extension assembly further comprises:
a second bracket disposed on an opposite side of the main beam member opposing the first bracket, the second bracket comprising:
a third flange comprising a proximal end and a distal end, the third flange coupled with each of the extension block and the proximal end of the main beam member; and
a fourth flange extending from the third flange at the proximal end of the third flange and coupled with the main structure such that the second bracket facilitates coupling of the extension block and the main beam member to the main structure, wherein the third flange has a third length that is greater than the first length.

10. A play structure comprising:
a main structure;
a swing set comprising:
a main beam member comprising a proximal end and a distal end;
a pair of leg members coupled with the distal end; and
at least one swing suspended from the main beam member between the proximal end and the distal end; and an extension assembly comprising:

an extension block disposed between the main structure and the proximal end of the main beam member; and a pair of brackets disposed on opposite sides of the main beam member, each bracket of the pair of brackets comprising:

a first flange comprising a proximal end and a distal end, the first flange extending along a plane;

a second flange extending from the first flange at the proximal end such that the second flange is disposed on one side of the plane; and a pair of side flanges extending from the first flange such that the pair of side flanges are disposed on an opposite side of the plane as the second flange, wherein:

each side flange of the pair of side flanges extends at least partially between the proximal end and the distal end of the first flange;

each side flange of the pair of side flanges extends at least partially over one or more of the extension block and the main beam member;

the extension block has a first length; and the first flange has a second length that is greater than the first length.

11. The play structure of claim 10, wherein for each bracket of the pair of brackets:

the second flange is generally orthogonal to the first flange; and each side flange of the pair of side flanges is generally orthogonal to the first flange.

12. A kit for assembling at least a portion of a play structure, the kit comprising:

a swing set comprising:

a main beam member comprising a proximal end and a distal end;

a pair of leg members configured for coupling with the distal end; and at least one swing configured for suspension from the main beam member between the proximal end and the distal end; and an extension assembly comprising:

an extension block configured for abutment with the proximal end of the main beam member; and a bracket comprising:

a first flange comprising a proximal end and a distal end, the first flange extending along a plane and configured for coupling to each of the extension block and the proximal end of the main beam member; and a second flange extending from the first flange at the proximal end of the first flange such that the second flange is disposed on one side of the plane, the second flange configured for coupling to a main structure such that the bracket facilitates coupling of the extension block and the main beam member to the main structure, wherein:

the extension block has a first length; and the first flange has a second length that is greater than the first length.

* * * * *